United States Patent [19]

Davis et al.

[11] 4,319,992

[45] Mar. 16, 1982

[54] MATERIAL SEPARATING MACHINE

[75] Inventors: William F. Davis, Massillon; Masataka Tsutsumi, Canton, both of Ohio

[73] Assignee: Midwestern Industries, Inc., Massillon, Ohio

[21] Appl. No.: 201,493

[22] Filed: Oct. 28, 1980

[51] Int. Cl.[3] ..... B07B 1/48

[52] U.S. Cl. ..... 209/275; 209/319; 209/403; 209/405

[58] Field of Search ..... 209/275, 314, 315, 319, 209/355, 402–405

[56] References Cited

U.S. PATENT DOCUMENTS

| | | | |
|---|---|---|---|
| 2,285,347 | 6/1942 | Morgan | 209/403 |
| 2,378,463 | 6/1945 | Burls | 209/403 X |
| 2,853,191 | 9/1958 | Mogensen | 209/315 |
| 3,439,800 | 4/1969 | Tonjes | 209/314 X |
| 3,655,045 | 4/1972 | McAllister, Jr. | 209/405 X |
| 3,718,963 | 3/1973 | Hawkins et al. | 209/403 X |

*Primary Examiner*—William A. Cuchlinski, Jr.

[57] ABSTRACT

A material separating device (10) includes a frame member (13) which carries a plurality of vertically arranged support members (19–23). Each of the support members (19–23) includes a plurality of support rods (19A–D, 20A–D, 21A–D, 22A–D, 23A–D). Screen elements (24–28) are stretched by adjustable tensioning devices (30) over each of the support members (19–23) to form screen panels (24*a–e*, 25*a–e*, 26*a–e*, 27*a–e*, 28*a–e*) between the support rods (19A–D, 20A–D, 21A–D, 22A–D, 23A–D). Each successive screen panel (24*a–e*, 25*a–e*, 26*a–e*, 27*a–e*, 28*a–e*) is inclined at a greater angle than the preceding screen panel (24*a–e*, 25*a–e*, 26*a–e*, 27*a–e*, 28*a–e*) so that material being separated moves progressively faster as it traverses each screen element (24–28).

7 Claims, 4 Drawing Figures

MATERIAL SEPARATING MACHINE

TECHNICAL FIELD

This invention relates to an apparatus for separating a composite material into a plurality of groups according to the screen size through which the groups will pass. More particularly, this invention relates to a vertical sizing apparatus wherein a composite material stream is split into selected cuts by size.

BACKGROUND ART

Vertical sizing or classifying of a stream of composite material is known. The prior art is typified by U.S. Pat. No. 2,853,191 wherein a stream of material is fed to a first inclined flat screen with all but the coarsest of the materials of the composite passing therethrough to a second screen therebelow. The process continues through a plurality of screens dependent on the number of groups into which the material is to be classified. In said patent all of the screens are of the same mesh but the effective openings of the screens is varied by varying the angle of the mount of each screen so that lower screens are progressively more vertically inclined thus reducing the effective size of the openings therein.

The basic advantage of the vertical sizing concept in general is that a high volume stream can be quickly divided. Most of the division is accomplished at the point the material is introduced to the screens with the remaining lower portions of the screen primarily acting as a conveying medium to transfer the material out of the machine. The problem encountered by the device of U.S. Pat. No. 2,853,191 is that because of the angular orientation of the screens there is little retention time of particles on the screen. If any high volume classification is attempted, some particles will never contact the screen surface but will rather remain in layers and drop quickly down the incline without ever being tested by the screen for size. Thus, the device of said patent does not accomplish the basic advantage of vertical sizing, i.e., efficient high volume separation.

Further problems have been encountered in these types of devices because of the manner in which the screens are tensioned. Usually a plurality of spring loaded draw bolt type tensioning devices are used for each screen. However, since the screens are under severe tension, breakage of a draw bolt is not uncommon. When such occurs, the recoil of the spring and flying broken parts could cause injury to a person in the vicinity. The prior art of which we are aware does not provide any type of convenient yet safe tensioning device.

Nor has the prior art solved the problem of adequate tensioning. Because the screens of the prior art are straight, there are limits to the amount of tension which can be placed thereon. A more highly tensioned screen will more efficiently separate the material thereon.

DISCLOSURE OF THE INVENTION

It is thus a primary object of the present invention to provide a material separating device which permits particle screen retention time in the area of the screens where most separation occurs.

It is another object of the present invention to provide a material separating device, as above, which quickly moves material off the screens in a shallow bed after being retained at the prime separation area.

It is an additional object of the present invention to provide a material separating device, as above, which utilizes a plurality of stacked screens of varying mesh size to effect the particle separation.

It is a further object of the present invention to provide a material separating device, as above, in which the screen is easily, adjustably, and safely tensioned.

It is still another object of the present invention to provide a material separating device, as above, in which each screen is divided into screen panels with each successive panel being downwardly inclined at a greater angle than the preceding panel to form, in effect, an arcuate screen which may be tensioned to a high degree.

These and other objects of the present invention, which will become apparent from the description to follow, are accomplished by the means hereinafter described and claimed.

In general, a material separating device includes a frame member which carries a plurality of vertically arranged sets of screen supports, each set including a plurality of supporting devices. A screen element is tensioned over each set of screen supports to form screen panels between each supporting device within each set of supports. Each successive screen panel is downwardly inclined at a greater angle than the preceeding panel so that material to be separated moves progressively faster as it traverses the screen element.

PREFERRED EMBODIMENT FOR CARRYING OUT THE INVENTION

Figure 1:
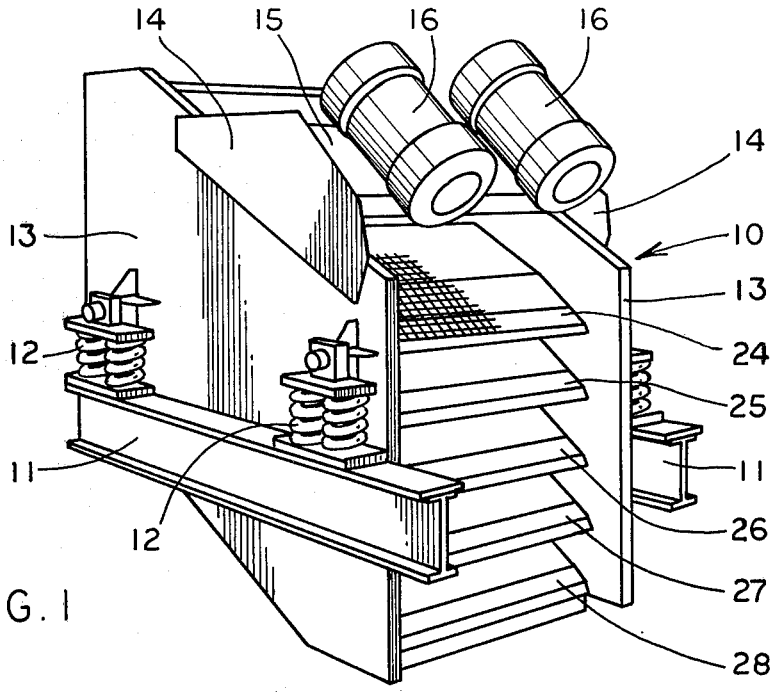
FIG. 1 is a somewhat schematic perspective view of the material separating device according to the concept of the present invention.

A material separator according to the present invention is indicated generally by the numeral 10 in FIG. 1 and is schematically shown as being mounted on two fixed I-beam pedestals 11. Pedestals 11 support springs 12 which are attached to upstanding vibratory frame members 13. Mounted near the top of each frame 13 are trunnion-like plates 14 which support a motor mount plate 15 therebetween. Plate 15 carries two vibratory motors 16 preferably of the type having an adjustable amplitude to control the vibrations imparted to separator 10. Thus the material separator 10 including frames 13 and everything supported thereby will be controllably vibrated by motors 16.

Figure 2:
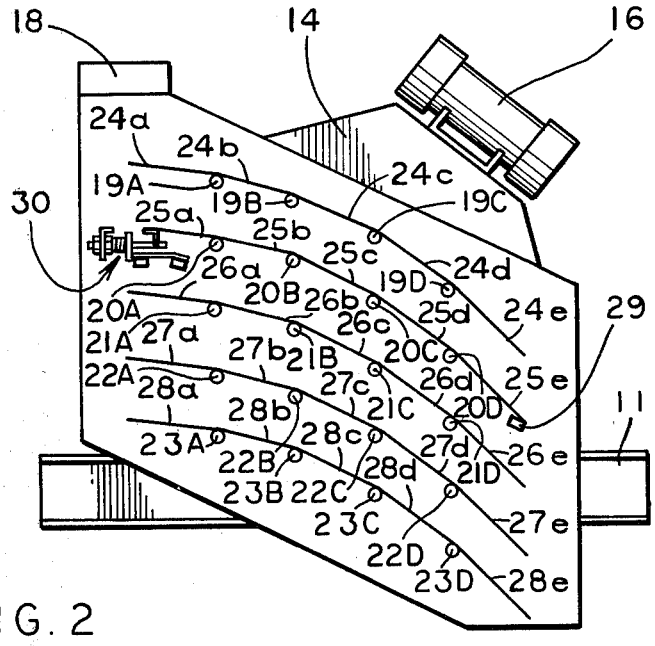
FIG. 2 is a schematic side sectional view of the material separating device of FIG. 1 showing the arrangement of the screen elements.

As best shown in FIG. 2 separator 10 is provided with an input chute 18 into which material to be separated is fed to a screening area between frames 13. Mounted between frames 13 are a plurality of sets of vertically arranged screen supporting devices 19–23, inclusive, each set including a plurality of screen supporting rods 19A–19D, inclusive, 20A–20D, inclusive, 21A–21D, inclusive, 22A–22D, inclusive, and 23A–23D, inclusive, respectively. Separating devices, in the preferred form, screen cloths 24–28, inclusive, are stretched over each set of supporting devices 19–23, inclusive, respectively, and form screen panels **24*a*–24*e***, inclusive, 25*a*–25*e*, inclusive, 26*a*–26*e*, inclusive, 27*a*–27*e*, inclusive, and 28*a*–28*e*, inclusive, between the respective support rods. The screens are thus mounted parallel of each other throughout their entire length over all of the screen panels. Each screen 24–28, inclusive, is permanently mounted at the discharge end, as at 29 (one shown in FIG. 2), and adjustably tensioned at the input end by tensioning devices (one shown) indicated generally by the numeral 30 in FIG. 2 and shown in detail in FIG. 3 to be hereinafter described.

The screens 24–28, inclusive, and supporting devices 19–23, inclusive, are generally identical except that in the preferred form the screens are of a progressively finer mesh, that is, screen 24 has the largest openings therein with screen 28 being of the finest mesh. Thus, as material enters the screening area through chute 18 the largest particles are retained thereon with the remainder passing therethrough to screen 25 and so forth. With five screens, as shown, six divisions are made with the separated material being collected at the end by discharge chutes not shown.

Since the screens and supporting devices are otherwise identical, a detailed description thereof will be made only with respect to supporting device 19 and screen 24. As shown, each successive support rod 19 from input to output is mounted lower than the previous rod. When the screen cloth 24 is stretched over the rods, it takes on a generally overall arcuate configuration. However, in actuality, between support rods, each panel 24*a*–24*e*, inclusive, is linear with successive screen panels being downwardly inclined at a greater angle than the preceding panel. Although these angles are not extremely critical and can be varied for particular applications, it has been found that the following inclinations provide ideal separation: screen panel 24*a*, 8° from horizontal; screen panel 24*b*, 15° from horizontal; screen panel 24*c*, 25° from horizontal; screen panel 24*d*, 35° from horizontal; and screen panel 24*e*, 43° from horizontal. It should be appreciated that because these screen panels are so inclined the effective openings in the screen, as seen by the particles to be separated, will be progressively less than the actual opening in the screen. The size of the effective opening for each screen panel is, in fact, the cosine of the above noted angles times the size of the actual opening.

The vast majority of the material entering chute 18 will go through panels 24*a*, 25*a*, 26*a*, 27*a* and 28*a*, rather than the remaining panels. This immediate shear or drop-through is occasioned not only because of the larger effective opening of these panels but also because the angle of inclination thereof is not greater providing more particle retention time on these panels. Such retention time gives each particle more pass-retain encounters with the screen. As the material which will not go through these first panels moves to panels 24*b*, 25*b*, 26*b*, 27*b* and 28*b*, they begin to accelerate and stratify in a shallow layer which again increases encounters with the screen. The rapid acceleration over the remaining panels, mounted at an ever increasing angle as described above, enables the device to work at high capacities.

Figure 3:
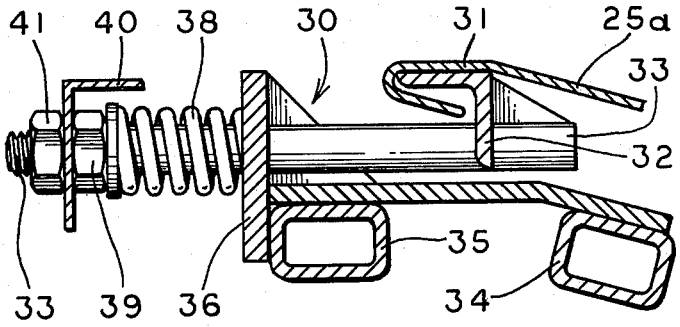
FIG. 3 is a sectional view of the screen tensioning device utilized with the material separating device of FIG. 1.

Effective and efficient separation is also controllable by the adjustable screen tension device 30 best shown in FIG. 3, which is a detailed view of that shown in FIG. 2. Each screen is provided with a plurality of such devices 30, preferably four, to provide even tensioning across the screen. The end of each screen (panel 25*a* being shown) is formed with a rigid hook member 31 which hooks around an angle iron 32 attached to a draw bolt 33. Two support members 34 and 35 extend between frames 13 and carry a stationary bearing plate 36 thereon. A heavy duty spring 38 is positioned around draw bolt 33 between bearing plate 36 and a tensioning nut 39. Rotation of nut 39 acts against spring 38 to move draw bolt 33 and adjust the tension on the screen. Because the screen panel 25*a* is angled upwardly toward angle iron 32 terminating in hook member 31, the horizontal movement of draw bolt 33 will not only tighten the screen laterally (to the left in FIG. 3) but will also pull the screen downward so that it is quite taught over support rods 19.

Figure 4:
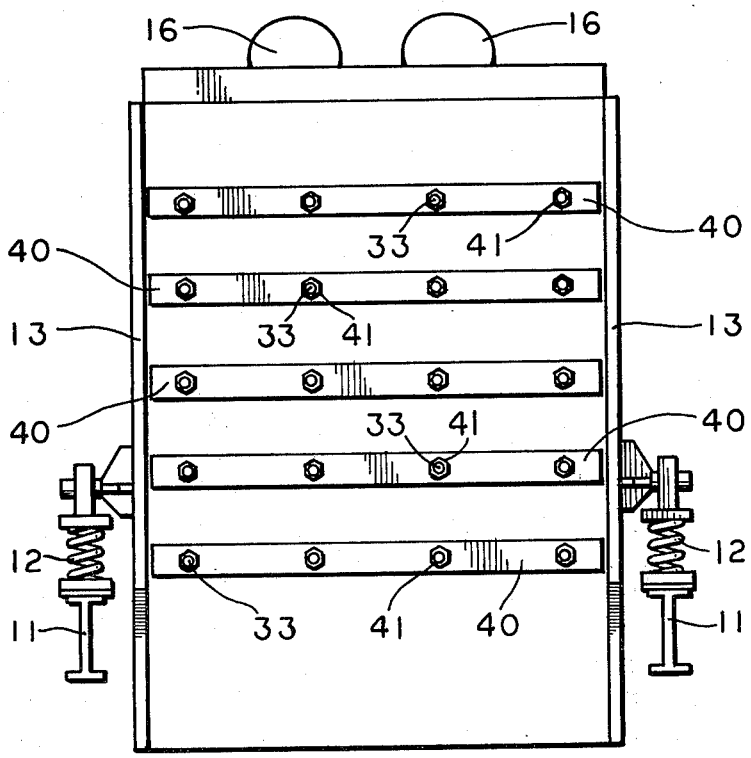
FIG. 4 is a somewhat schematic rear elevational view of the material separating device in FIG. 1.

As previously described, each screen is provided with a plurality of tensioning devices as is evident from FIG. 4. In the event of breakage of a draw bolt 33 which would cause spring 38 and the broken parts to recoil away from bearing plate 36, a safety bar 40 is provided. As shown in FIG. 4, bar 40 connects all of the tensioning devices 30 of each screen together and is held thereto by jam nuts 41. Therefore, if one draw bolt 33 should happen to break, recoil will be prevented by virtue of the connection to the other tensioning devices.

It should thus be evident that a material separating device constructed in accordance with the invention herein substantially improves the art and otherwise accomplishes the objects of the present invention.

We claim:

1. Apparatus for separating a composite material into groups classified according to the screen size through which the groups will pass comprising a frame member, a plurality of vertically arranged supporting means carried by said frame member, each said supporting means including a plurality of supports, a screen element tensioned over each of said supporting means forming screen panels between said supports, each successive screen panel being downwardly inclined at a greater angle than the preceding screen panel so that material to be separated moves progressively faster as it traverses the screen element, a plurality of tensioning devices for each said screen element, and safety bar means connected to each of said tensioning devices of each said screen element to hold a said tensioning device in place should it break.

2. Apparatus according to claim 1 wherein each of said screen elements are parallel with the other.

3. Apparatus according to claim 2 wherein said screen elements are vertically arranged, each having different sized openings from the others, the uppermost of said screen elements having the largest openings and the lowermost of said screen elements having the smallest openings.

4. Apparatus according to claim 1 wherein said screen elements are vertically arranged one above the other and further comprising input means above the uppermost of said screen elements positioned so that material passing therethrough contacts the screen panel of said uppermost screen element having the least inclination.

5. Apparatus according to claim 1 wherein the first of said screen panels is downwardly inclined at an angle of approximately 8°, the next of said screen panels is downwardly inclined at an angle of approximately 15°, the next of said screen panels is downwardly inclined at an angle of approximately 25°, the next of said screen panels is downwardly inclined at an angle of aproximately 35°, and the last of said screen panels is downwardly inclined at an angle of approximately α43 °.

6. Apparatus according to claim 1 wherein said tensioning devices are positioned with respect to each said screen element so as to tension each said screen element downwardly on each said plurality of supports.

7. Apparatus according to claim 1 wherein said tensioning devices include a bearing plate, a draw bolt connected to said screen element and passing through said bearing plate, an adjusting nut on said draw bolt, and a spring around said draw bolt and between said bearing plate and said adjusting nut so that rotation of said adjusting nut changes the tension on said screen element.

* * * * *